United States Patent [19]

Wheeler

[11] 4,143,379

[45] Mar. 6, 1979

[54] ANTENNA SYSTEM HAVING MODULAR COUPLING NETWORK

[75] Inventor: Harold A. Wheeler, Smithtown, N.Y.

[73] Assignee: Hazeltine Corporation, Greenlawn, N.Y.

[21] Appl. No.: 815,617

[22] Filed: Jul. 14, 1977

[51] Int. Cl.[2] ..... H01Q 3/26

[52] U.S. Cl. ..... 343/854; 343/844

[58] Field of Search ..... 343/854, 853, 844, 100 SA, 343/700 MS, 779, 778, 705, 708

[56] References Cited

U.S. PATENT DOCUMENTS

| | | | |
|---|---|---|---|
| 3,943,523 | 3/1976 | Fassett | 343/854 |
| 3,964,066 | 6/1976 | Nemit | 343/854 |
| 3,997,900 | 12/1976 | Chin et al. | 343/854 |
| 4,041,501 | 8/1977 | Frazita et al. | 343/854 |

*Primary Examiner*—Alfred E. Smith
*Assistant Examiner*—David K. Moore

[57] ABSTRACT

An antenna system having an array of radiating elements arranged in element modules is provided with coupling networks, one associated with each element module, each network having an input port. Each coupling network provides coupling between its input port and elements in the associated element module, as well as independent coupling between its input port and selected elements associated with other modules in the array.

14 Claims, 9 Drawing Figures

(PRIOR ART-NEMIT)

(PRIOR ART-FRAZITA, et al)

ANTENNA SYSTEM HAVING MODULAR COUPLING NETWORK

BACKGROUND OF THE INVENTION

This invention relates to array antenna systems and particularly to such systems wherein the antenna element pattern is modified by providing a coupling network between the antenna input ports and antenna elements, so that the effective element pattern associated with each input port is primarily within a selected angular region of space.

An array antenna system may be designed to transmit a desired radiation pattern into one of a plurality of angular directions in a selected region of space. In accordance with the customary design of array antennas, each of the antenna elements has an associated input port and by variation of the amplitude and/or phase of the wave energy signals supplied to the input ports, the antenna pattern can be electronically steered in space to point in the desired radiation direction or otherwise controlled to radiate a desired signal characteristic, such as a Doppler pattern. When it is desired to have an array antenna radiate its beam over a selected limited region of space, it is preferable that the radiation pattern of the individual antenna elements also be primarily within the selected angular region. This permits maximum element spacing while suppressing undesired grating lobes. Control of the element pattern by modification of the physical shape of the antenna element may be impractical because the desired element pattern may require an element aperture size which exceeds the necessary element spacing in the array. A practical approach to overcome the physical element size limitation is to provide networks for interconnecting each antenna input port with more than one antenna element, so that the effective element pattern associated with each input port is formed by the composite radiation of several elements.

One prior art approach to this problem has been described by Nemit in U.S. Pat. No. 3,803,625. Nemit achieves a larger effective element size by providing intermediate antenna elements between the primary antenna elements and coupling signals from the primary antenna element input ports to the intermediate elements. This approach is illustrated in FIG. 1 which shows an array of elements 10, 11 which are coupled to input ports 12. The signals supplied to input ports 12 are split by power dividers 13 and supplied directly to primary elements 10 by transmission line 14 and to intermediate elements 11 by transmission lines 16 and power combiner 17. Nemit's approach provides an aperture excitation consisting of three active elements for signals supplied to each of the input ports. When a signal indicated by arrow 18 is supplied to any of the input ports 12, the associated primary antenna element 10 has a large amplitude excitation indicated by arrow 19 and the adjacent intermediate antenna elements 11 have a lower amplitude excitation indicated by arrows 20. This tapered multi-element aperture excitation produces some measure of control over the radiated antenna pattern.

A more effective prior art antenna coupling network is described by Frazita et al. in allowed U.S. pat. application Ser. No. 594,934, filed July 10, 1975 and now U.S. Pat. No. 4,041,501, which is assigned to the same assignee as the present invention. According to the technique of Frazita, illustrated in FIG. 2, the antenna elements 22 are arranged in element modules 20, each of which is provided with an input port 24. Transmission lines 26 and 28 are coupled to all of the antenna element modules 20 in the array and couple signals supplied to any of input ports 24 to selected elements in all the antenna element modules of the array, thereby providing an effective element aperture which is co-extensive with the array aperture. The signals supplied to the elements have a tapered amplitude distribution and periodical phase reversal to approximate an ideal sin x/x aperture distribution which produces a sharply defined sectoral effective element pattern. This technique is an effective and cost efficient method for obtaining substantial control over the effective antenna element pattern for each input port.

It is an object of the present invention to provide an alternate array antenna system having antenna element pattern control by the intercoupling of antenna element modules.

SUMMARY OF THE INVENTION

In accordance with the invention, there is provided an antenna system for radiating wave energy signals into a selected angular region of space and in a desired radiation pattern. The system includes an aperture comprising a plurality of antenna element modules, each comprising a pair of element groups. Each element group has one or more radiated antenna elements. The element modules and element groups are arranged along a predetermined path. Each of the element modules has an associated coupling network having an input port, a pair of output ports connected to the element groups and cross-coupling ports connected to the coupling networks associated with the adjacent element modules along the path. The coupling networks include coupling means for interconnecting the input port with the output ports, the input port with the cross-coupling ports, and the output ports with selected cross-coupling ports. Wave energy signals supplied to the input ports are coupled to the element groups in the element module and to select element groups in adjacent element modules to cause the aperture to radiate primarily in the selected region of space.

Each of the coupling networks may also include a fourth coupling means independent of the second and third coupling means for interconnecting cross-coupling ports on opposite sides of the coupling network. The coupling networks may be fabricated using printed circuit transmission lines in a single layer, and include directional couplers and coupler type crossovers. The cross-coupling ports on the end most coupling networks of the array are preferably terminated by resistive terminations.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
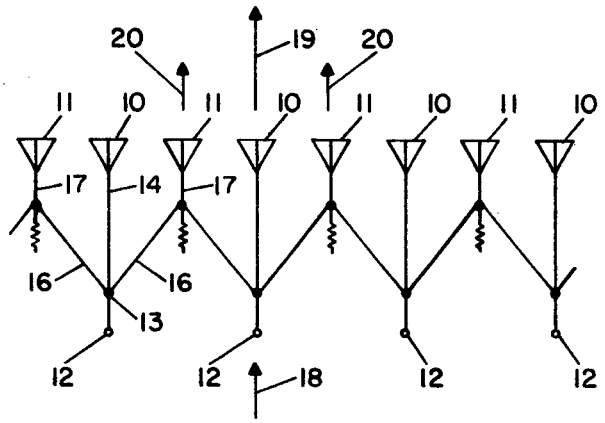
FIG. 1 is a schematic diagram of an antenna system in accordance with the prior art.
Figure 2:
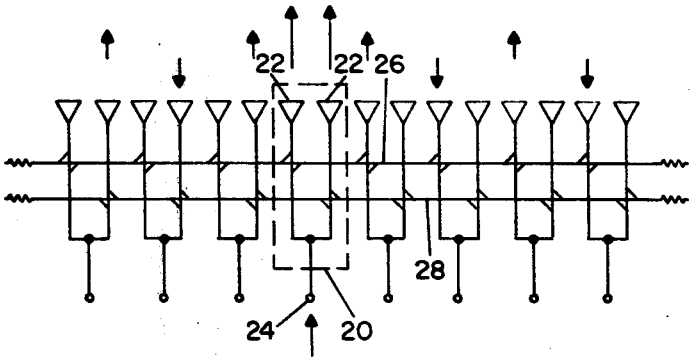
FIG. 2 is a schematic diagram of another antenna system in accordance with the prior art.
Figure 3:
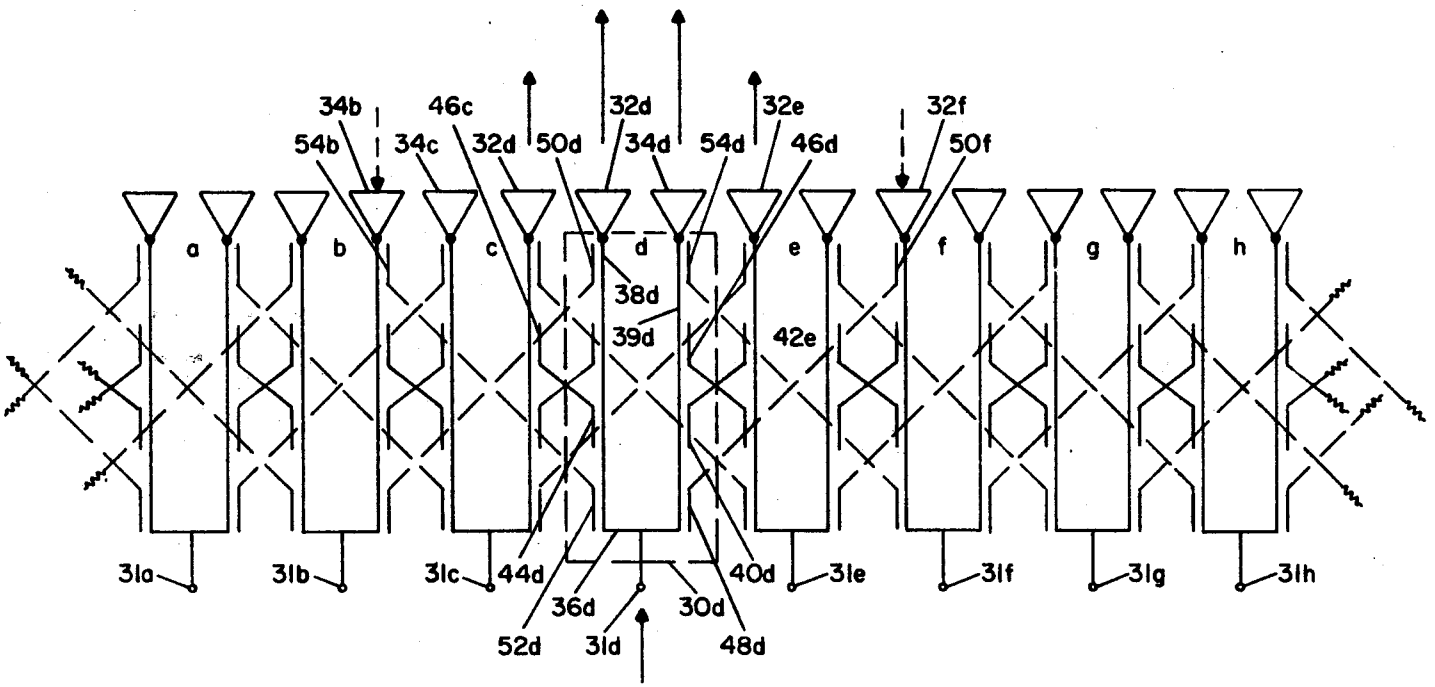
FIG. 3 is a schematic diagram of an antenna system in accordance with the present invention.

FIG. 3 is a schematic diagram illustrating an antenna system in accordance with the present invention. The diagram of FIG. 3 includes a plurality of antenna element modules a through h. Each of the modules is provided with an input port 31, a coupling network 30, and a pair of antenna element groups, each group in this case comprising a corresponding one of the radiating elements 32, 34. The coupling networks include directional couplers which are schematically illustrated as closely spaced parallel transmission lines.

The structure and operation of the invention will be explained with respect to coupling network **30*d***, which is associated with module d and enclosed by dotted lines in FIG. 3. Those familiar with networks of the type will understand that the operation of this particular network is typical of the operation of the networks associated with all modules in the antenna system.

Network **30*d* is provided with an input port 31*d* which is connected to the input of power divider 36*d*, which is shown as a simple reactive T junction. Hybrids or couplers may be substituted for the T junction shown, as is well known by those familiar with the art. The outputs of junction 36*d* are connected by transmission lines 38*d* and 39*d* to antenna elements 32*d* and 34*d*. The connections between transmission lines 38*d*, 39*d* and antenna elements 32*d*, 34*d* form the output ports of coupling network 30*d*. Transmission line 39*d* is provided with coupler 48*d* which couples a selected amount of the wave energy signals supplied to input terminal 31 and is connected to supply the coupled signals to coupler 50*f* which is connected to antenna element 32*f*. In order to simplify the drawing of FIG. 3, the transmission line connecting couplers 48*d* and 50*f* is shown as a dotted line. A second coupler 40*d* couples additional wave energy signals from transmission line 39*d* and supplies the coupled signals to element 32*e* by coupler 42*e*. Transmission line 38*d* is likewise provided with couplers 52*d* and 44*d* which couple supplied signals to elements 34*b* and 34*c* by couplers 54*b* and 46*c*, respectively. Module 30*d* includes couplers 46*d*, 54*d*, 42*d* and 50*d*** for receiving coupled signals corresponding to signals supplied to the input ports of other element modules in the array.

As becomes evident from the Figure, network **30*d* is connected to the adjacent coupling networks by cross-couple ports on both sides of the network. Six cross-coupling ports are provided on each side of each network and constitute the transmission lines interconnecting the directional couplers in the various networks. Network 30*d* has cross-coupling ports connected by couplers 40*d*, 44*d*, 48*d* and 52*d* to input terminal 31*d* for supplying a portion of the input signal energy to the adjacent element modules b, c, e, and f. Additional cross-coupling ports are connected to the coupling network output ports by couplers 42*d*, 46*d*, 50*d*, and 54*d*** and serve to receive wave energy signals supplied to the input ports of networks b, c, e, and f. The network also includes cross-coupling ports corresponding to the inter-network connection of the transmission lines indicated as dotted lines which couple signals between the adjacent element modules c and e.

The coupling networks of FIG. 3 cause signals to be supplied to six element groups of the antenna aperture from each of input ports 31. The signals supplied to each of these element groups are selected to have an amplitude and phase which will cause the antenna to radiate primarily in a selected region of space in response to the supplied wave energy. Thus, the effective element pattern of the array is confined to the region within which the antenna must radiate and the effective element spacing can be increased, reducing the number of input ports and consequently the number of phase or amplitude control elements, since grating lobes outside the selected region will be suppressed. The coupling of the supplied signal in accordance with the FIG. 3 network provides an effective element aperture equal to approximately five element modules. The aperture excitation to yield an approximately uniform element pattern within a selected region is a sin x/x amplitude distribution, which is approximated by the excitation illustrated.

It is an important feature of the present invention that the coupling to each element group from the input ports is independent of the coupling to other element groups. Consequently, the amplitude excitation of the elements can be determined by computer simulation of the effective element pattern and the excitation amplitude and phase can be independently adjusted for each of the coupled element groups.

Figure 4:
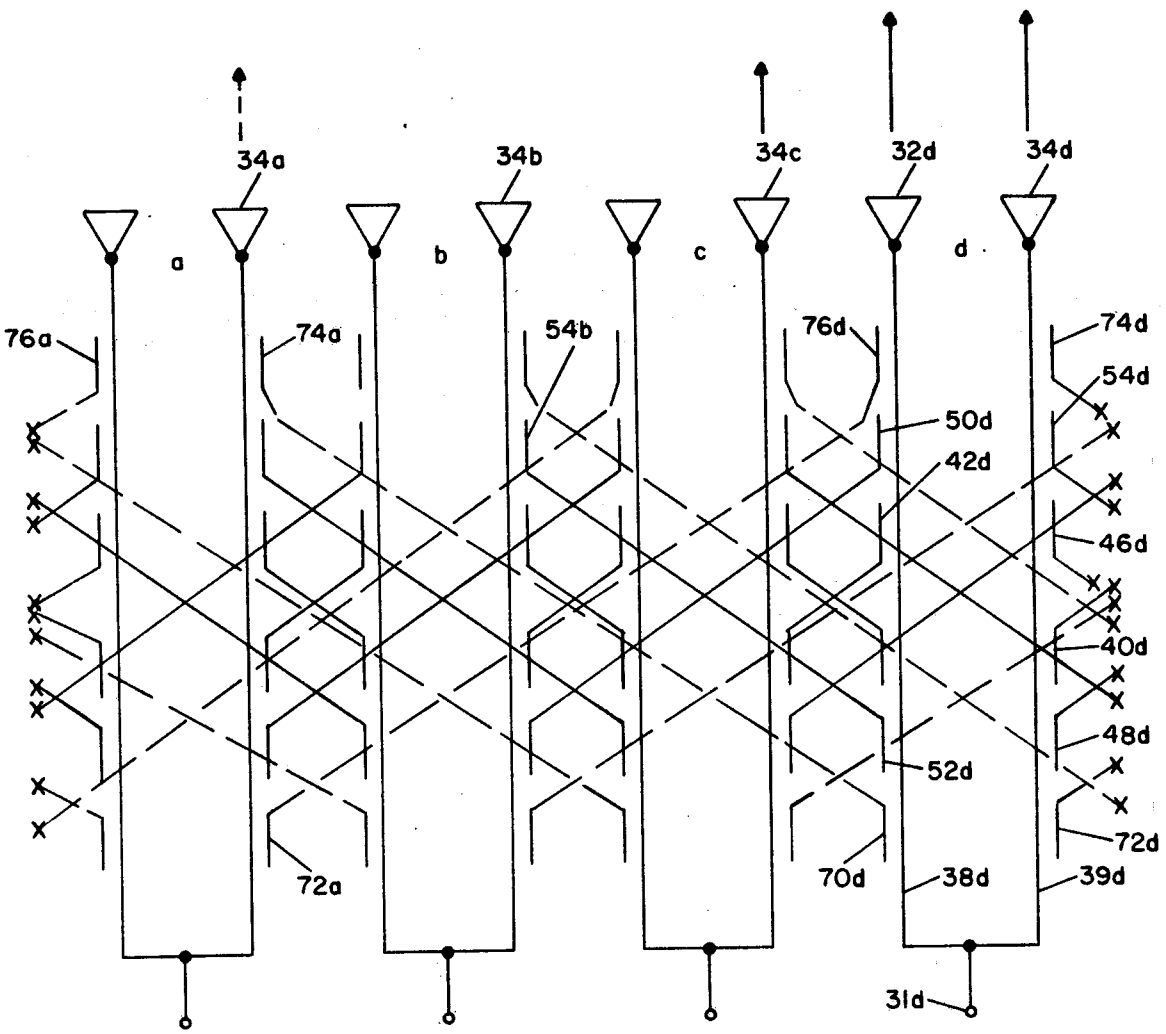
FIG. 4 is a schematic diagram of another antenna system in accordance with the present invention.

FIG. 4 is a schematic diagram of a portion of an antenna system in accordance with the invention which has a more complex cross-coupling arrangement. The networks of the FIG. 4 antenna system include an additional set of output couplers 70 and 72 associated with each of the transmission lines 38 and 39, which are connected to corresponding couplers 74 and 76 associated with the third adjoining antenna element module. The FIG. 3 antenna provides the excitation of six antenna element groups in response to signals supplied to each input port 31. The network illustrated partially in FIG. 4 provides for the excitation of four symmetrical element group pairs, or a total of eight antenna element groups, when wave energy signals are supplied at the input 31 of each antenna module. Consequently, the arrangement of FIG. 4, while more complex than that of FIG. 3, can provide better control of the effective element pattern by the use of a larger effective element aperture.

Figure 5:
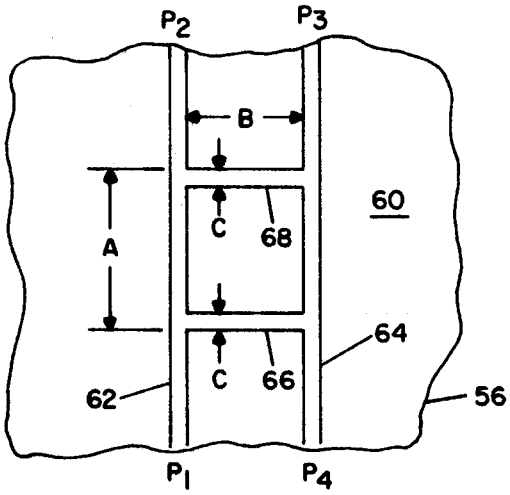
FIGS. 5 and 5A are plan and cross-sectional views of a branch line coupler useful in the present invention.
Figure 5A:
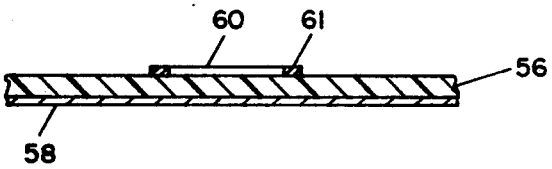
Figure 6:
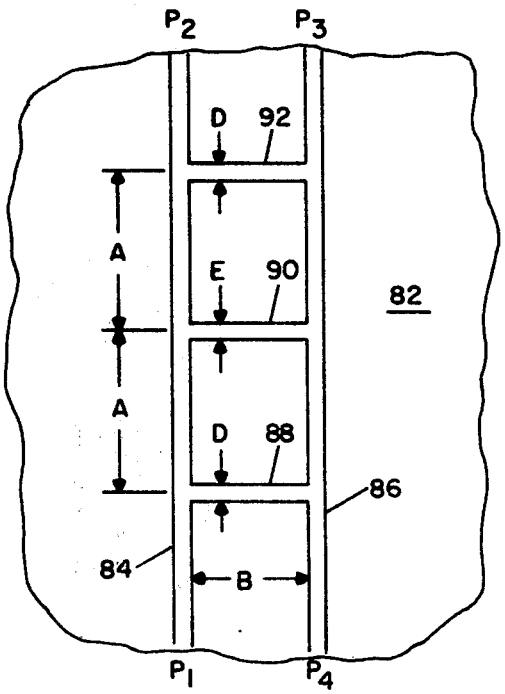
FIG. 6 is a plan view of a coupler type crossover useful in the present invention.

FIGS. 5 and 6 illustrate transmission line coupling circuits useful in the present invention. The large number of transmission line directional couplers and a large number of interconnecting transmission lines which must cross each other in the network of the present invention makes it desirable that the network be manufactured as a single layer of printed circuit transmission line. This manufacturing method makes practical the implementation of an antenna system with a complex network through the use of relatively inexpensive circuit printing techniques.

FIG. 5 illustrates a branch line directional coupler, which is well-known in the art and is useful for implementing the networks of FIGS. 3 and 4. The printed circuit coupler of FIG. 5 is formed of microstrip transmission line which consists of a thin sheet 56 of dielectric material having a conductive ground plane 58 on one surface and a thin conductive printed circuit 61 on the opposite surface. The branch line coupler 60 of FIG. 5 makes use of two coupling transmission lines 66 and 68 joining primary transmission lines 62 and 64. Transmission lines 62 and 64 are arranged a distance B, preferably a quarter wavelength, from each other and the interconnecting transmission lines 66 and 68 are separated by a distance A, which is also preferably a quarter wavelength. Four network ports labelled P1, P2, P3, and P4 are associated with coupler 60. The operation of the coupler is reciprocal and the effect of supplying signals to any port can be understood with reference to an exemplary port, for example P1. If port P1 is supplied with wave energy signals, these signals are primarily supplied to port P2, which is called the "direct" port. According to the width C of transmission lines 66 and 68, a selected amount of the supplied signal is provided to the coupled port P3. Port P4 is the isolated port of the coupler with respect to port P1 and receives substantially none of the energy supplied to port P1. The isolated port is normally terminated by a resistive load.

FIG. 6 illustrates a special class of branch line directional coupler 82 which is called a "zero-dB coupler." One function served by coupler 82 is to provide for a crossover of two transmission lines without coupling signals between the transmission lines. The crossover coupler 82 is provided with three connecting transmission lines 88, 90, and 92 between the primary transmission lines 84 and 86. Signals supplied to input port P1 are supplied to port P3 with "zero-dB" of coupling, or substantially no reduction in signal level. Consequently, no energy is supplied to ports P2 or P4. Signals supplied to port P4 are likewise coupled to port P2 and isolated from ports P1 and P3. It will therefore be recognized that the printed circuit 82 illustrated in FIG. 6 effectively provides a crossover between transmission lines within a single plane of a printed circuit network. It will likewise be evident that it is necessary to select branch line dimensions D and E to achieve the correct amount of coupling to provide the crossover function.

Figure 7:
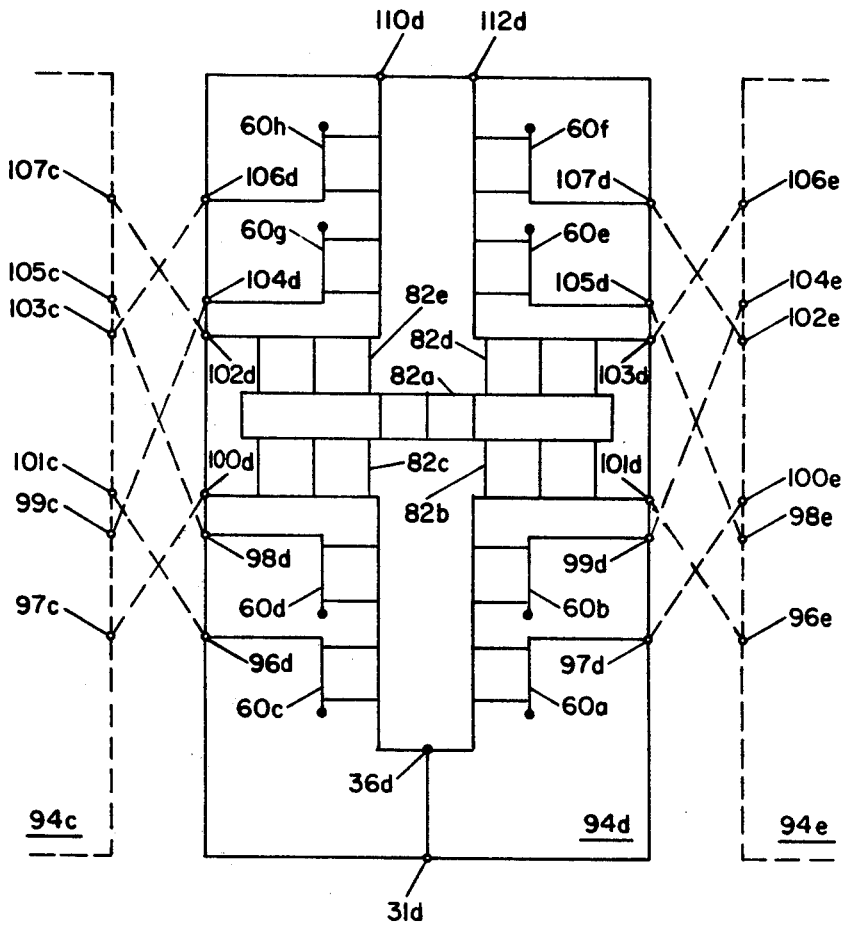
FIG. 7 is a plan view of a printed circuit coupling network useful in the present invention.

FIG. 7 illustrates a coupling network **94*d* which makes use of circuits 60 and 82 to provide the coupling functions illustrated schematically in FIG. 3. Network 94*d* inlcudes an input port 31*d* which is connected to the input of power divider 36*d*. One output of divider 36*d* is connected to couplers 60*a* and 60*b*, which correspond to couplers 48*d* and 40*d* respectively of the FIG. 3 network. The coupled port of couplers 60*a* and 60*b* are provided to network cross-coupling ports 97*d* and 99*d* respectively, for interconnection by transmission lines to cross-coupling ports 100*e* and 104*e* of the adjacent network 94*e*. The output signal from the right side of power divider 36*d* is provided to crossover 82*b*, crossover 82*d* and eventually to output port 112*d*. Couplers 60*e* and 60*f* are provided for connecting cross-coupling ports 105*d* and 107*d* to output port 112*d*. Cross-coupling port 101*d* is connected to cross-coupling port 102*d* by crossovers 82*b*, 82*a*, and 82*d*. Likewise, cross-coupling port 103*d* is connected to cross-coupling port 100*d* by crossovers 82*d*, 82*a*, and 82*c*. Additonal transmission line crossovers are provided by the arrangement of transmission lines, such as coaxial cables, interconnecting the cross-coupling ports of adjacent coupling networks 94. The FIG. 7 network is symmetrical about the input port, consequently, the output of the left side of power divider 36 is provided with couplers 60*c*, 60*d*, 60*g*, and 60*h* connected to cross-coupling ports 96*d*, 98*d*, 104*d*, and 106*d*** respectively.

Figure 8:
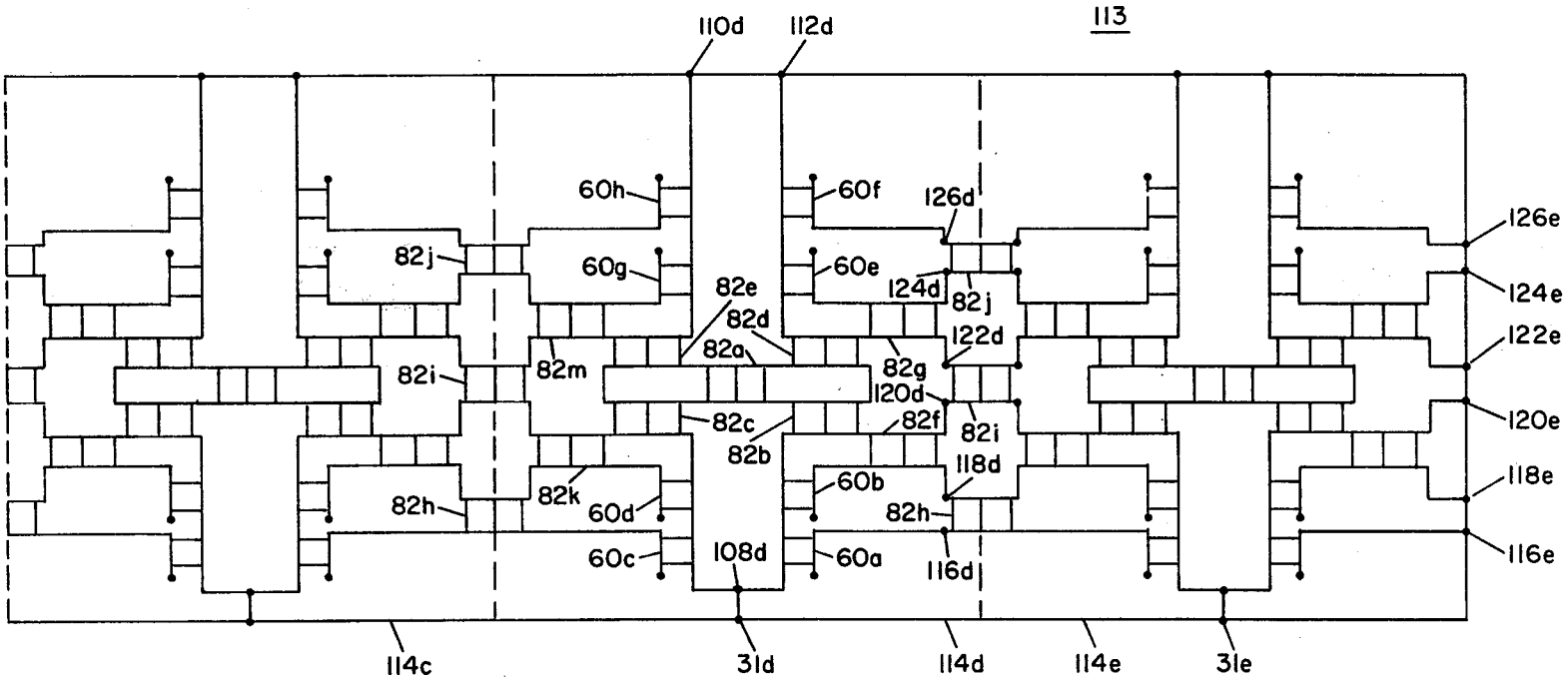
FIG. 8 is a planar view of a multiple printed circuit coupling network arranged on a single substrate and useful in the present invention.

FIG. 8 illustrates a printed circuit 113 which includes the elements of network 94 and additional printed circuit crossovers so that a number of coupling networks such as **114*c*, 114*d*, and 114*e* may be included on a single printed circuit board. It should be recognized that the cross-coupling ports 116 through 126 of the end network on the printed circuit board may be connected by transmission lines to an adjacent printed circuit board or, if network 113 is the end network in an array, cross-coupling ports 116 through 126 may be terminated in resistive loads. Each network 114 of circuit 113 includes crossovers 82*f* through 82*m* in addition to the circuit elements of the FIG. 7 network 94. These are the printed circuit equivalents of the transmission line crossovers used to interconnect the cross-coupling ports of the FIG. 7 networks. The cross-coupling ports of the networks 114 are not terminals for connection to cables, but are selected points 116 through 126 on the transmission lines of circuit 113 between networks 114**.

In the foregoing description and in FIGS. 3 and 4, the output ports of each coupling network are illustrated as being connected to a single antenna element. Those familiar with antenna systems will recognize that this single antenna element may instead be an element group comprising more than one radiating antenna element. The elements in a group may be arranged along the path of the element groups and modules of the array or may be arranged in a perpendicular path to achieve pattern control in a orthogonal plane of radiation. Likewise, each output port could be connected to one of the inputs of an orthogonally arranged array of coupling networks and antenna elements to achieve element pattern control in both planes of radiation, in the manner shown in FIG. 14 of the aforementioned application of Frazita et al.

Those familiar with antenna systems will recognize that the antenna system of the present invention may be utilized in any of the ways described in the above-mentioned application of Frazita, et al. according to the type of signals supplied to the input ports. The appropriate portions of the Frazita et al. specification are therefore incorporated herein by reference. It will also be recognized that while the antenna and network operation has been described with reference to transmitter operation, such antennas and networks are fully reciprocal and the specification and claims are equally applicable to antennas for use as receiving antennas.

While there have been described what are believed to be the preferred embodiments of the invention, those skilled in the art will recognize that other and further modifications may be made thereto without departing from the spirit of the invention and it is intended to claim all such embodiments as fall within the true scope of the invention.

I claim:

1. An antenna system for radiating wave energy signals into a selected angular region of space and in a desired radiation pattern, comprising:

an aperture comprising a plurality of antenna element modules, each module comprising a pair of element groups, each group comprising one or more radiating antenna elements, said element modules and element groups being arranged along a predetermined path;

and a plurality of coupling networks each associated with one of said element modules, each of said coupling networks having an input port, a pair of output ports each connected to the antenna elements of one of the associated element groups, cross-coupling ports connected to the coupling networks associated with the adjacent element modules along said path, first coupling means interconnecting said input port and said output ports, second coupling means interconnecting said input port and selected ones of said cross-coupling ports and third coupling means, independent of said second coupling means, interconnecting said output ports and selected ones of said cross-coupling ports;

whereby when wave energy signals are supplied to the input port of any of said networks, said signals are coupled to the antenna elements in the element module associated with said network and to selected element groups in adjacent element modules, to cause said aperture to radiate said desired radiation pattern primarily within said selected region of space.

2. An antenna system as specified in claim 1 wherein each of said coupling networks further includes fourth coupling means, independent of said first, second, and third coupling means, for interconnecting selected ones of said cross-coupling ports associated with adjacent element modules on both sides of said coupling network.

3. An antenna system as specified in claim 1 wherein said coupling networks consist of transmission lines, directional couplers and crossover couplers.

4. An antenna system as specified in claim 1 wherein each of said coupling networks is fabricated from printed circuit transmission line.

5. An antenna system as specified in claim 4 wherein said transmission line includes at least one conductive ground plane and a conductive circuit separated from said ground plane by dielectric material.

6. An antenna system as specified in claim 4 wherein said coupling networks comprise a single level of said printed circuit transmission line and include branch line directional couplers and printed circuit crossovers comprising three branch directional couplers.

7. An antenna system for radiating wave energy signals into a selected angular region of space and in a desired radiation pattern, comprising:

an aperture comprising a plurality of antenna element modules, each module comprising a pair of element groups, each group comprising one or more radiating antenna elements, said element modules and element groups being arranged along a predetermined path;

and a plurality of coupling networks, each associated with one of said element modules, each of said coupling networks having an input port connected to the input of a power divider, a pair of output ports each connected to the antenna elements of one of the associated element groups, a pair of transmission lines connecting the outputs of said power divider and said output ports, and three sets of cross-coupling ports arranged for connection to the adjacent coupling networks on opposite sides of said coupling network including:

first cross-coupling ports coupled to said output ports;

second cross-coupling ports coupled to said power divider outputs;

and third cross-coupling ports coupled to each other on opposite sides of said coupling network;

whereby when wave energy signals are supplied to the input port of any of said networks, said signals are coupled to the antenna elements in the element module associated with said network and to selected element groups in adjacent element modules, to cause said aperture to radiate said desired radiation pattern primarily within said selected region of space.

8. An antenna system as specified in claim 7 wherein said first cross-coupling ports are coupled to said output ports by said transmission lines and directional couplers.

9. An antenna system as specified in claim 8 wherein said second cross-coupling ports are coupled to said power divider outputs by said transmission lines and directional couplers.

10. An antenna system as specified in claim 7 wherein said third cross-coupling ports on opposite sides of said coupling network are interconnected by transmission lines and directional coupler crossovers.

11. An antenna system as specified in claim 7 wherein said coupling network is a single layer printed circuit transmission line network.

12. An antenna system as specified in claim 7 wherein there are provided resistive terminations on the outer cross-coupling ports of the networks associated with the outermost element modules along said path.

13. A coupling network for use in an array antenna system for coupling supplied wave energy signals to antenna radiating elements, said network comprising:

a primary input port;

a pair of primary output ports;

a plurality of cross-coupling ports;

first coupling means for coupling supplied wave energy signals from said input port to said output ports;

second coupling means for coupling wave energy signals from said first coupling means to selected ones of said cross-coupling ports;

and third coupling means, independent of said second coupling means, for coupling each of said output ports to selected ones of said cross-coupling ports other than those which are fed by said second coupling means.

14. A coupling network as specified in claim 13 wherein said network further includes fourth coupling means, independent of said second coupling means, for interconnecting selected ones of said cross-coupling ports other than those previously mentioned herein.

* * * * *